US007021617B2

(12) United States Patent
Herrmann et al.

(10) Patent No.: US 7,021,617 B2
(45) Date of Patent: Apr. 4, 2006

(54) CLAMP ACTUATOR SYSTEM AND METHOD OF USE

(75) Inventors: Douglas K. Herrmann, Webster, NY (US); Timothy M. Davis, Macedon, NY (US); Matthew J. Ross, Walworth, NY (US); Brian J. Dunham, Webster, NY (US)

(73) Assignee: Xerox Corporation, Stamford, CT (US)

( * ) Notice: Subject to any disclaimer, the term of this patent is extended or adjusted under 35 U.S.C. 154(b) by 175 days.

(21) Appl. No.: 10/740,491

(22) Filed: Dec. 22, 2003

(65) Prior Publication Data

US 2005/0206065 A1 Sep. 22, 2005

(51) Int. Cl.
*G03G 15/00* (2006.01)

(52) U.S. Cl. ..... 270/58.11; 399/369; 400/624; 400/626; 294/104; 294/111

(58) Field of Classification Search ..... 270/58.11, 270/58.13; 414/790.2; 399/403, 404, 405, 399/362, 369, 377, 361; 400/624, 626, 627, 400/628; 294/111, 103.1, 104
See application file for complete search history.

(56) References Cited

U.S. PATENT DOCUMENTS

| | | | | |
|---|---|---|---|---|
| 3,556,503 A | | 1/1971 | van Moss, Jr. | |
| 3,670,661 A | | 6/1972 | Pangailla | |
| 3,735,711 A | | 5/1973 | Hassenauer | |
| 3,910,655 A | | 10/1975 | Willison et al. | |
| 3,932,005 A | | 1/1976 | Miller | |
| 3,957,318 A | | 5/1976 | Wiebe | |
| 4,017,066 A | | 4/1977 | Lasher et al. | |
| 4,134,672 A | * | 1/1979 | Burlew et al. | 399/410 |
| 4,355,583 A | | 10/1982 | Eggert, Jr. | |
| 4,406,449 A | * | 9/1983 | Buck | 271/189 |
| 4,545,715 A | * | 10/1985 | Seefeldt | 414/789.1 |
| 4,567,833 A | | 2/1986 | Hanson | |
| 4,589,645 A | | 5/1986 | Tracy | |
| 4,637,598 A | | 1/1987 | Bouwens et al. | |
| 4,793,720 A | | 12/1988 | Merker, Jr. | |
| 4,934,683 A | | 6/1990 | Ueda et al. | |
| 4,998,997 A | | 3/1991 | Carlson | |
| 5,026,034 A | | 6/1991 | Russel et al. | |
| 5,088,714 A | | 2/1992 | Nagasawa et al. | |
| 5,169,135 A | | 12/1992 | Hamanaka et al. | |

(Continued)

FOREIGN PATENT DOCUMENTS

GB 2 157 272 A 10/1985

(Continued)

OTHER PUBLICATIONS

U.S. Appl. No. 10/652,106, filed Aug. 29, 2003, Herrmann et al.

(Continued)

*Primary Examiner*—Patrick Mackey
(74) *Attorney, Agent, or Firm*—Oliff & Berridge, PLC; Eugene Palazzo

(57) ABSTRACT

A substrate compiling system includes an actuator, cable and tamper device. The tamper device includes a clamp assembly. The clamp assembly is retracted and extended. The clamp assembly can be used to clamp an edge of each compiled set of substrates and transfer the compiled set to a stacking tray, platform or the like. The clamp assembly may remain in an extended position until all other substrate supporting structures no longer support the substrates and an opposing unclamped edge of the compiled set engages the stacking tray below.

17 Claims, 9 Drawing Sheets

U.S. PATENT DOCUMENTS

| | | | | |
|---|---|---|---|---|
| 5,386,783 | A | 2/1995 | Rhen et al. | |
| 5,484,256 | A * | 1/1996 | Claassen | 414/790.8 |
| 5,601,031 | A | 2/1997 | Carlson | |
| 5,649,695 | A | 7/1997 | Lawrence | |
| 5,678,818 | A * | 10/1997 | Hayashi et al. | 271/292 |
| 5,915,688 | A | 6/1999 | Klenk et al. | |
| 6,092,470 | A | 7/2000 | O'Donnell | |
| 6,357,736 | B1 * | 3/2002 | Kubota et al. | 270/58.08 |
| 6,819,906 | B1 * | 11/2004 | Herrmann et al. | 399/368 |

FOREIGN PATENT DOCUMENTS

| | | | |
|---|---|---|---|
| GB | 2157272 A | * | 10/1985 |

OTHER PUBLICATIONS

EP Search Report dated May 13, 2005.

Miner Enterprises, Inc.; TecsPak Constant Contact Side Bearings; 1996; 2 pages; Geneva, Illinois, USA.

* cited by examiner

FIG. 1
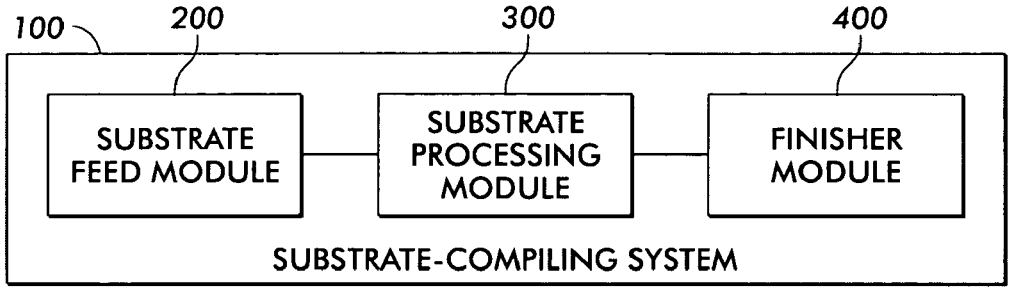
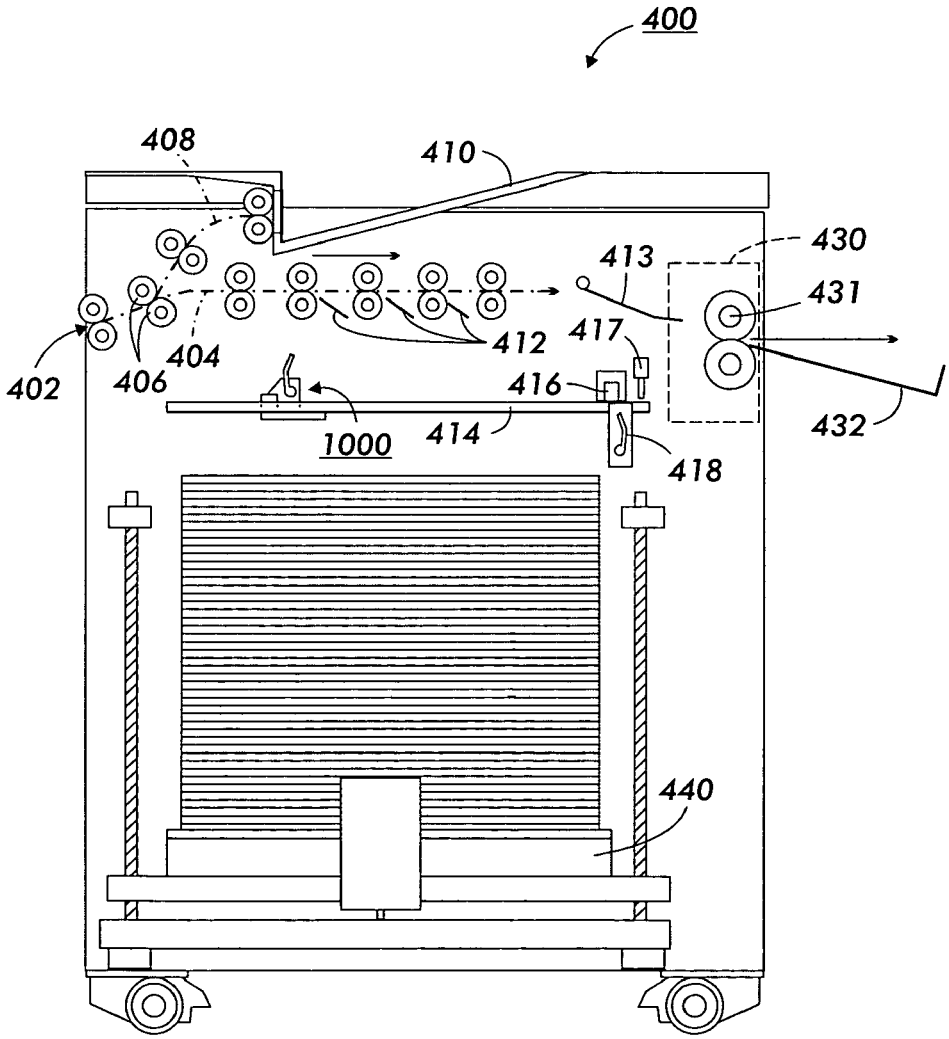
FIG. 2

CLAMP ACTUATOR SYSTEM AND METHOD OF USE

INCORPORATION BY REFERENCE

The entire disclosure of each of the following documents is hereby incorporated by reference herein in its entirety: U.S. patent application Ser. No. 10/652,106; U.S. Pat. Nos. 4,017,066; 4,589,645; 4,637,598; 4,934,683; 5,026,034; 5,088,714; 5,169,135; 5,915,688; and 5,649,695.

BACKGROUND OF THE INVENTION

1. Field of Invention

This invention generally relates to systems and methods for clamping and transferring compiled substrates.

2. Description of Related Art

The compilation or collection of flexible substrates including sheets of paper, plastic, and/or the like, is desirable in various fields of production including individual use, publication, imaging, and/or the like. To maintain proper alignment, or registration, of the substrates is desirable to provide an organized, neatly stacked compilation that can be transferred without unwanted creasing and/or scattering of the substrates.

Conventional systems and methods for compiling and transferring substrates, such as sheets of paper, are related to an image forming apparatus, such as a copier or printer, or any other device where a compilation of substrates is desired. The substrates can be sorted and/or collated using various types of apparatus, separators, holders, and/or the like. The following U.S. Patents are noted by way of example: U.S. Pat. Nos. 4,017,066; 4,589,645; 4,637,598; 4,934,683; 5,026,034; 5,088,714; 5,169,135; 5,915,688; and 5,649,695.

These conventional systems usually require each compiled set to be transferred from a compilation platform to a stacking tray that holds and/or stacks one or more compiled sets. Each compiled set is usually dropped, pushed out, and/or pulled from the compilation platform in order to transfer the compiled set to the stacking tray.

SUMMARY OF THE INVENTION

In an image forming apparatus, since the lead edge of the compiled set drops first to transfer the compiled set to the holding area, the trail edge of the compiled set is only supported from underneath the bottom substrate of the set. Thus, the trail edges of the substrates in the compiled set still become misaligned in various directions. When the lead edge of the compiled set is not bound with a staple, adhesive, fastener or the like, the potential exists for even greater misalignment.

This invention provides systems and methods for transferring compiled sets of substrates while reducing the misalignment of the substrates in the compiled sets.

In embodiments, this invention provides a clamping and transferring system approach that helps reduce the footprint or lateral space requirement to help maximize the efficiency of space used in the finishing devices, i.e. devices which can provide pre-collated sets, compiled sets, bound sets and/or the like, especially in high volume finishing applications that may or may not have multiple discharge paths.

In embodiments, this invention provides a clamping and transferring system that can handle substrates of various materials, weights and sizes.

In embodiments, this invention provides a clamping and transferring system that helps reduce the weight of a tamper device and helps increase the efficiency of the alignment of substrates in the compiled set, especially in high speed applications.

In embodiments, this invention provides a clamping and transferring system approach that provides a force on a cable to clamp substrates in the compiled set.

In embodiments, this invention provides systems and methods for clamping compiled sets of substrate to reduce the scattering of substrates in the compiled set.

In embodiments, this invention provides systems and methods for clamping compiled sets of substrate to reduce the scattering of substrates in the compiled set.

In embodiments, this invention provides system and methods for clamping compiled sets of substrate to ensure that the substrates of each set always remain controlled. That is, by clamping, and therefore positively controlling, the trail edge of the compiled set during the drop and/or transfer from a compile position to the stack, stacking tray, platform or the like, scattering of the substrates in the compiled set is reduced.

In various exemplary embodiments of the systems and methods according this invention, substrates in a compiled set can be transferred while being clamped.

In various exemplary embodiments of the systems and methods according this invention, substrates in a compiled set can be transferred to a stacking tray in a controlled manner.

In various exemplary embodiments of the systems and methods according this invention, the clamp actuator system includes an actuator, a cable and a tamper device. The tamper device may include a platform and a clamp mechanism. The clamp mechanism may include a substrate support device and a clamp assembly to clamp a trail edge of a compiled set to reduce scattering of the substrates in the compiled set. The clamp mechanism is preferably lightweight to reduce the weight of a tamper device and help increase the efficiency of the alignment of substrates.

In various exemplary embodiments of the systems and methods according this invention, the clamp assembly can be retracted and extended. For example, the clamp assembly can be retracted to compile a set of substrates and then extended to transfer the compiled set.

In various exemplary embodiments of the systems and methods according this invention, the actuator provides a force on the cable to clamp substrates in the compiled set. For example, as the actuator exerts a force on the cable, and preferably the clamp assembly moves from a retracted position to an extended position, the clamp assembly exerts a substantially constant amount of force on the clamped compiled set.

In various exemplary embodiments of the systems and methods according this invention, the substrates in a compiled set can be transferred to a stacking tray in a controlled manner.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of the systems and method according to this invention will be described in detail, with reference to the following figures, wherein:

FIG. 1 is a schematic diagram of one exemplary embodiment of a substrate compiling system according to this invention;

FIG. 2 illustrates one exemplary embodiment of a finisher module;

DETAILED DESCRIPTION OF PREFERRED EMBODIMENTS

Figure 3:
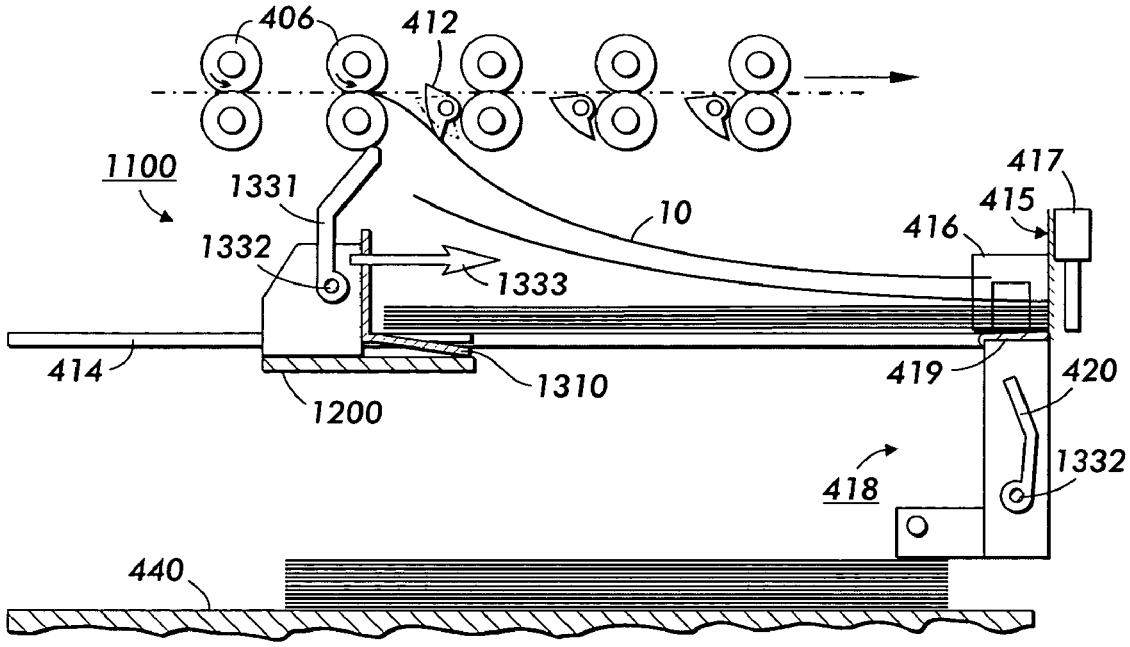
FIG. 3 illustrates an exemplary compiler/finisher/set stacker system for substrates, showing incoming substrates being compiled and tamped by a clamp actuator system.

Various exemplary embodiments of the systems and methods according to this invention enable the clamping and transfer of flexible substrates in an image-forming system, substrate compilation system, or the like, to be advanced through the use of a clamp actuator system. Mechanisms and techniques used in the clamp actuator system according to this invention provide a combination of tamping, clamping and transporting.

The following detailed description of various exemplary embodiments of the substrate clamp actuator systems and methods according to this invention may refer to one specific type of substrate, copy sheets, for the sake of clarity and familiarity. Further, for the sake of clarity and familiarity, this invention may refer to one specific type of substrate-compiling device, i.e. a copier or printer. However, it should be appreciated that the principles of this invention, as outlined and/or discussed below, can be equally applied to any known or later-developed substrate and/or substrate-compiling device, or any other sheet-like substrate handling device, beyond any copy sheets and copiers specifically discussed herein.

FIG. 1 is a block diagram of one exemplary embodiment of a substrate-compiling system 100 in which a substrate may need to be registered and transported. As shown in FIG. 1, the substrate-compiling system 100 includes a substrate feed module 200, a substrate processing module 300 and a finisher module 400.

It should be appreciated that the substrate feed module 200, the substrate processing module 300 and the finisher module 400, while depicted as components of the substrate-compiling system 100 in FIG. 1, are not necessarily components of a single system. The functions and/or operations of any one or more of these elements may be carried out by separate and distinct devices, structures, and/or systems. Further, it should be appreciated that additional devices, structures and/or systems may be included in the substrate-compiling system 100, such as, for example, a substrate preparation module.

FIG. 2 illustrates one exemplary embodiment of the finisher module 400. As shown in FIG. 2, the finisher module 400 includes a substrate receiving inlet 402, a main transport path 404, transport nip rollers 406, a bypass path 408, a top bypass tray 410, diverter gates 412, a pair of retractable compiling shutters 414 (only one shutter is shown in this view since both shutters are located in the same horizontal plane), a manipulation device 416, a lead edge ejector 417, a lead edge system 418, a clamp actuator system 1000, an output unit 430, drive rollers 431, an output tray 432 and a stacking tray 440 for receiving compiled sets of substrates. A number of pairs of transport nip rollers 406 move the substrates along the main transport path 404 and/or the bypass path 408.

The manipulation device 416 can be any device capable of manipulating a substrate or a set of substrates, including, but not limited to, stapling, binding, punching, stitching, perforating and/or the like. It should be appreciated that the manipulation device 416 may be a separate component in the finisher module 400 and that the location and/or capability of the manipulation device 416 is a design choice and will be obvious to those skilled in the art.

It should further be appreciated that the manipulation device 416, while depicted as a component of the finisher module 400 in FIG. 2, is not necessarily a component of a single system. The functions and/or operations of the manipulation device 416 may be carried out by any number of separate and distinct devices, structures, and/or systems.

In operation, substrates are received from the substrate processing module 300 through the substrate receiving inlet 402. Substrates are transported along the main transport path 404 by the one or more pairs of transport nip rollers 406. Substrates that are not to be compiled into a set can be diverted to the top bypass tray 410 along the bypass path 408. Further, substrates that are not compiled into a set can be diverted to the output tray 432 along the main transport path 404 via a guide baffle 413 and the drive rollers 431 of the output unit 430. Otherwise, substrates are transported by the transport nip rollers 406 along the main transport path 404 and are diverted to the retractable compiling shutters 414 by one of the diverter gates 412 that divert the substrates sequentially onto upper surfaces of the retractable compiling shutters 414. The appropriate one of the diverter gates 412 used to divert the substrates can be determined based on the dimensions of the substrates.

It should be appreciated that the compiled sets stack tray 440 can be any platform, surface or the like capable of holding a set of compiled substrates after the compiled set is clamped and transferred.

FIGS. 3–7 illustrate various exemplary stages of operation of the finisher module 400.

As shown in FIG. 3, a substrate 10 is transported by the transport nip rollers 406 and sequentially diverted by one of the diverter gates 412 to form a compiled set of substrates. After the substrate 10 is diverted by one of the diverter gates 412, the substrate is temporarily supported by the retractable compiling shutters 414, a trail edge tamper device 1100 via a substrate support device 1310, and a lead edge guide 418 via a lead edge platform 419. Further, after the substrate 10 of the compiled set is supported by the above process and/or placed on top of another substrate in the set, the substrate 10 is aligned by the trail edge tamper device 1100 and side tampers (not shown). To align or tamp the substrate 10, the trail edge tamper device 1100 starts at an initial position in FIG. 3. Then, the trail edge tamper device 1100 moves along with the moving trail edge platform 1200 in the direction of arrow 1333 to push the substrate flush against an initial registration surface 415. Next, the moving trail edge platform 1200 returns to the initial position. The process described above is performed for each substrate 10 of the compiled set until the entire set of substrates is neatly stacked and compiled into an aligned compiled set.

Each compiled set of substrates may then be stapled, bound, punched, stitched, perforated and/or the like by the manipulation device 416, located in the area of the lead edge platform 419. After a set has been compiled and optionally manipulated, the set ejection process begins.

Figure 4:
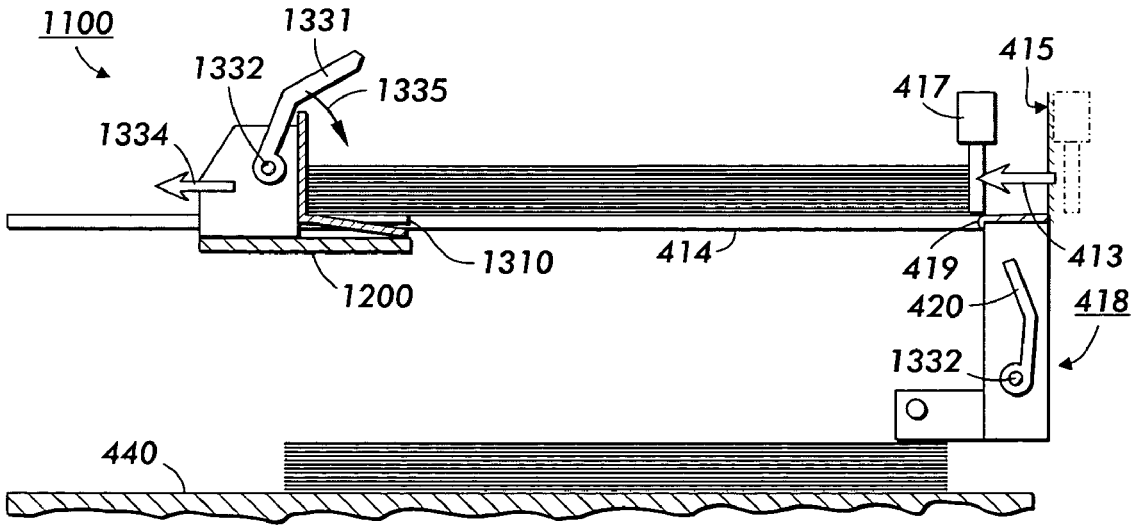
FIG. 4 illustrates the compiler/finisher/set stacker system of FIG. 3, showing a next step in which a set of substrates is compiled, ejected and the clamp actuator system is activated.
Figure 5:
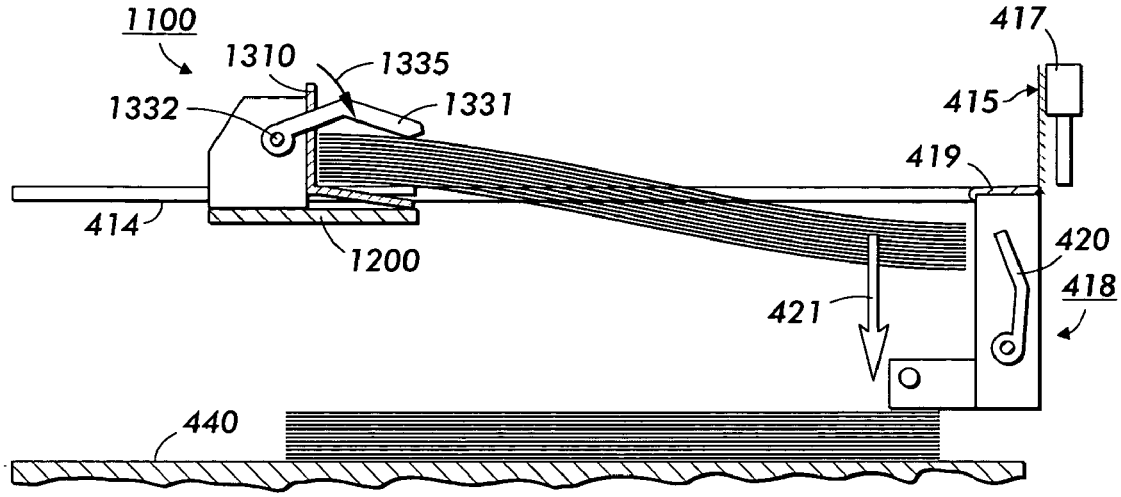
FIG. 5 illustrates the compiler/finisher/set stacker system of FIG. 4, showing a next step in which the compiled set starts to drop while the trail edge of the compiled set is fully clamped by the clamp actuator system.

FIGS. 4 and 5 illustrate the ejection of the compiled set of substrates. As shown in FIG. 4, the lead edge ejector 417 pushes a lead edge of the compiled set in the direction of arrow 413 away from the initial registration surface 415 until the lead edge platform 419 no longer supports the lead edge of the compiled set. As the lead edge of the compiled set is pushed by the lead edge ejector 417, the trail edge tamper device 1100 moves along with the moving trail edge platform 1200 in the direction of arrow 1334, the clamp members 1331 pivots in the direction of arrow 1335, and the retractable compiling shutters 414 move away from each other.

Next, as shown in FIG. 5, the lead edge of the compiled set is dropped to compiled sets stack tray 440 below. After the lead edge of the compiled set clears the lead edge platform 419, the retractable compiling shutters 414 are moved apart far enough to positions that remove edge support of the compiled set and the trail edge tamper device 1100 stops moving in the direction of arrow 1334. During the time when the lead edge of the compiled set is being cleared from the lead edge platform or edge support of the compiled set is being removed, the clamp members 1331 are fully extended in the direction of the arrow 1335 to clamp the compiled set to the substrate support device 1310 to keep the trail edge of the compiled set from slipping off the substrate support device 1310 as the lead edge of the compiled set drops in the direction of arrow 421 to the compiled sets stack tray 440 below. However, the clamp members 1331 are in a fully extended position before the compiling shutters 414 are moved to the positions that completely remove edge support of the compiled set.

Figure 6:
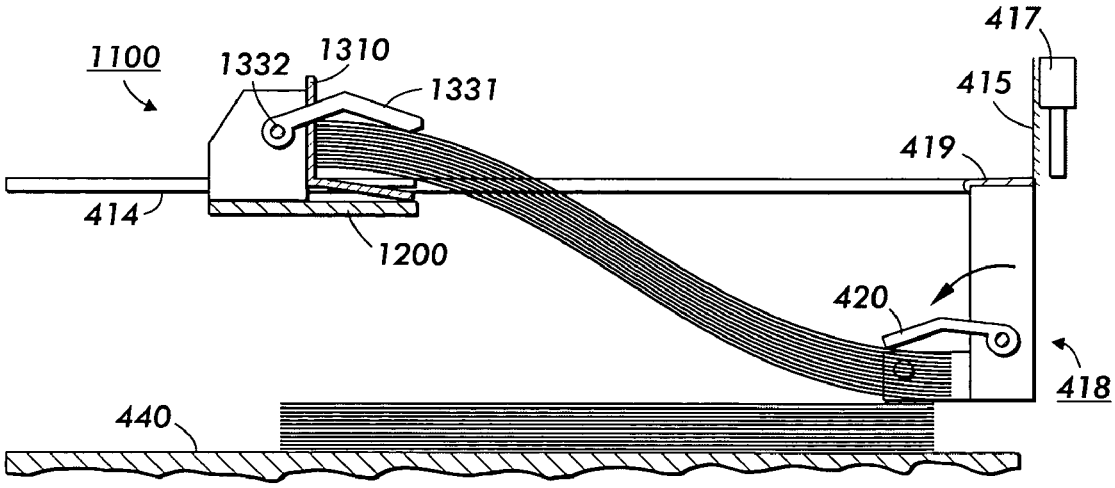
FIG. 6 illustrates the compiler/finisher/set stacker system of FIG. 5, showing a next step in which the lead edge of the compiled set has dropped all the way down on top of the previous stacked set on a stacking tray.

FIG. 6 illustrates the lead edge of the compiled set clamped down by the lead edge system 418 onto the top of the preceding stacked compiled set to prevent or reduce undesired movement of the current compiled set after the trail edge of the compiled set is dropped from the trail edge tamper device 1100 and lands on the lead edge system 418.

Figure 7:
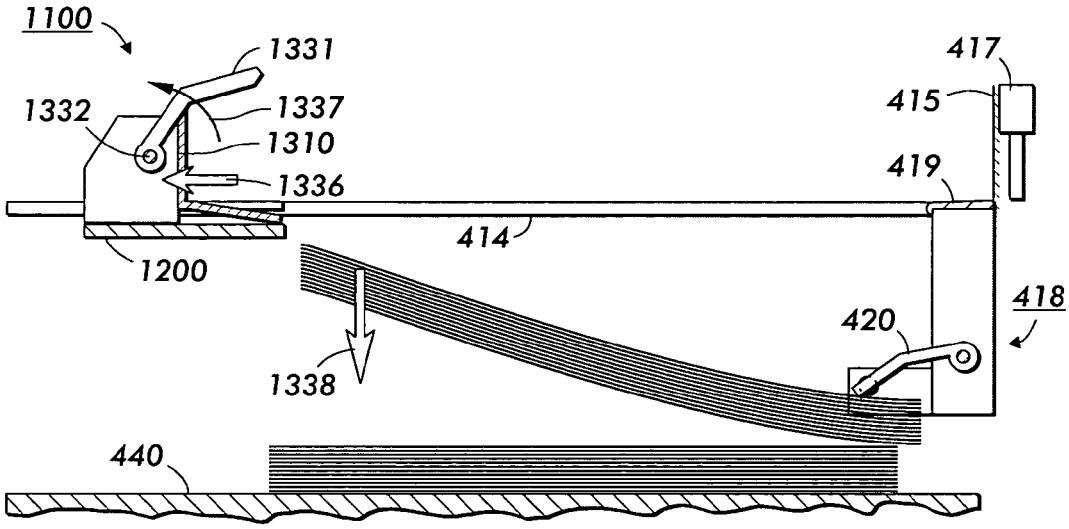
FIG. 7 illustrates the compiler/finisher/set stacker system of FIG. 6, showing a next step in which the clamp actuator system is deactivated to release the trail edge of the compiled set and the trail edge of the compiled set is dropped down on top of a previous stacked set on a stacking tray.

FIG. 7 illustrates the trail edge of the compiled set being dropped to compiled sets stack tray 440 below. After the lead edge of the compiled set is clamped by the lead edge system 418, the trail edge tamper device 1100 starts moving along with the moving trail edge platform 1200 in the direction of arrow 1336. During the time when the trail edge tamper device 1100 starts moving along with the moving trail edge platform 1200, the clamp members 1331 concurrently rotate in the direction of the arrow 1337 to release the trail edge of the compiled set so the compiled set drops in the direction of arrow 1338 to the compiled sets stack tray 440 below. Finally, the trail edge tamper device 1100 returns to the initial position and the operation discussed above with respect to FIGS. 3-7 then repeats to compile the next set of substrates for another compiled set.

It should be appreciated that the stacking tray can be any platform, surface, or the like capable of holding a set of compiled substrates after the compiled set is clamped and transferred. It should be also be appreciated that the actuator can be any device such as a motor assembly, manual lever or the like, capable of applying a force on the cable to allow the clamp mechanism to clamp a set of compiled substrates during the transfer of the compiled set to a stacking tray, platform, surface or the like.

The operation of the substrate-compiling system 100, including the finisher module 400 discussed above, operates under the control of a controller (not shown) in accordance with a program stored in a memory (not shown) and/or in response to feedback from any desired or necessary sensors (not shown), as will be appreciated by those skilled in the art.

The memory can be implemented using any appropriate combination of alterable, volatile or non-volatile memory or non-alterable, or fixed, memory. The alterable memory, whether volatile or non-volatile, can be implemented by using any one or more of static or dynamic RAM, a floppy disk and disk drive, a writeable or rewriteable optical disk and disk drive, a hard drive, flash memory or the like. Similarly, the non-alterable or fixed memory can be implemented using any one or more of ROM, PROM, EPROM, EEPROM, and gaps in optical ROM disk, such as a CD ROM or DVD ROM disk and disk drive, or the like.

Figure 8:
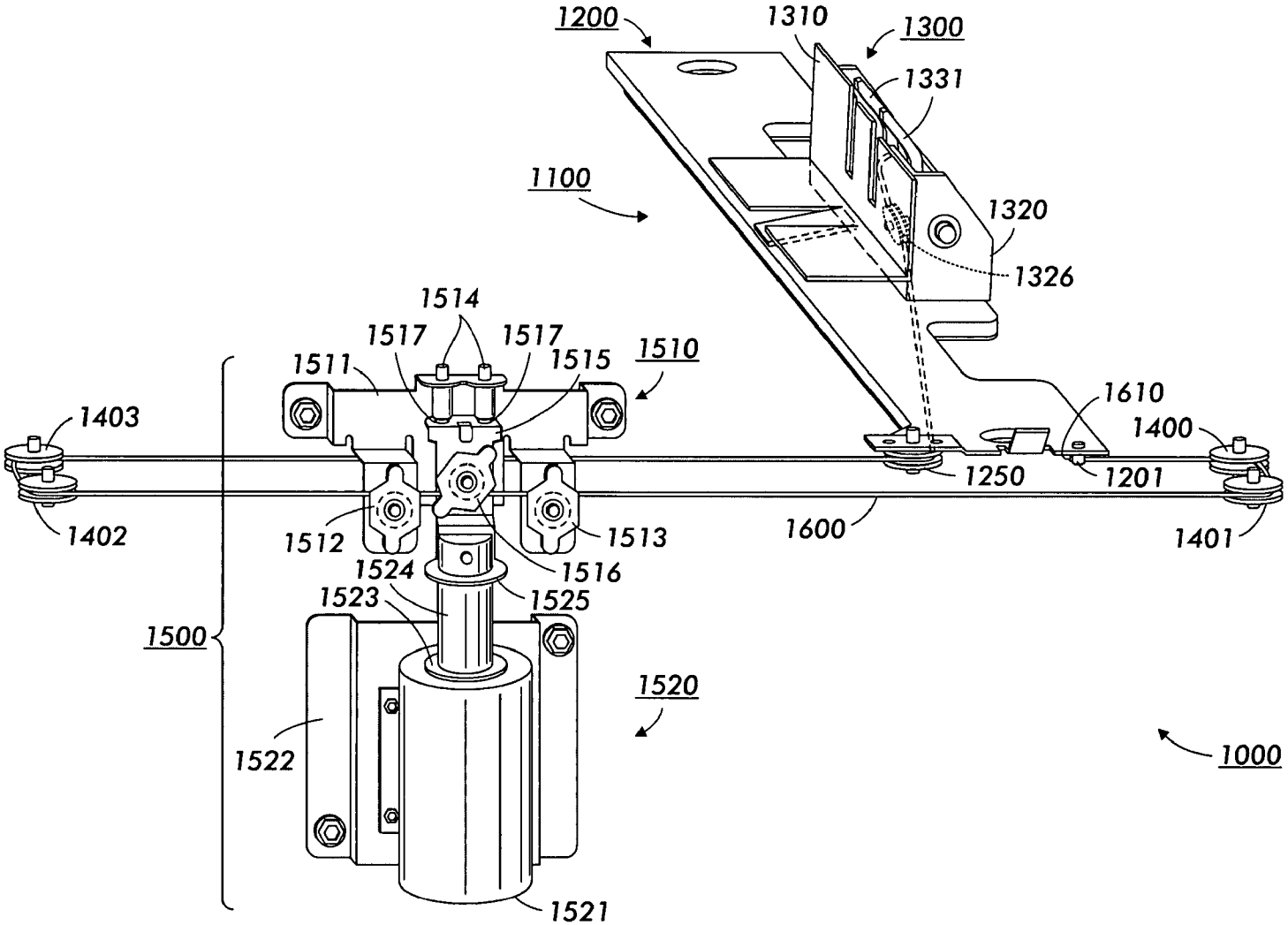
FIG. 8 illustrates in greater detail one exemplary embodiment of a clamp actuator system according to this invention, where the clamp actuator system is in a retracted position.

FIG. 8 illustrates in greater detail one exemplary embodiment of the clamp actuator system 1000. As shown in FIG. 8, the clamp actuator system 1000 includes a trail edge tamper device 1100, support frame guide members 1400–1403, an actuator 1500 and a cable 1600. The trail edge tamper device 1100 includes the trail edge platform 1200 and a trail edge clamp mechanism 1300. Further, the trail edge clamp mechanism 1300 includes the substrate support device 1310 and a housing 1320 that supports the clamp members 1331. In FIG. 8, the actuator 1500 is in a deactivated state with the clamp members 1331 in a retracted position.

As shown in FIG. 8, the actuator 1500 includes a guide bracket 1510 and an actuation device 1520. The guide bracket 1510 is a two-piece bracket including a fixed bracket 1511 and a movable bracket 1515. The fixed bracket 1511 is fixed to a support frame (not shown) of a compiling device and includes guide members 1512,1513 and at least one, preferably a pair of, parallel engagement posts 1514. The movable bracket 1515 includes a guide member 1516 and a pair of engaging through-holes 1517 that engage the pair of parallel engagement posts 1514 of the fixed bracket 1511. The guide members 1512,1513,1516, as well as guide members 1400,1410 fixed on the support frame, are guide members that guide the cable 1600.

As shown in FIG. 8, the actuation device 1520 includes an outer cylinder 1521 and a telescoping shaft 1524. The outer cylinder 1521 is fixed to the support frame by a support bracket 1522. Additionally, the outer cylinder 1521 has a fixed collar 1523 that receives one end of the telescoping shaft 1524. The other end of the telescoping shaft includes a fixed collar 1525 and is connected to the movable bracket 1515 to manipulate the cable 1600.

The manner in which the cable 1600 is guided throughout the clamp actuator system 1000 will be discussed in greater detail with respect to FIGS. 8–13. However, it should be appreciated that the guiding of the cable 1600 throughout the clamp actuator system 1000 is not limited to the following described sequence, e.g., the cable could be guided throughout the clamp actuator system 1000 in an opposite direction as long as the cable starts and ends at the trail edge clamp mechanism 1300.

One end 1610 of the cable 1600 is fixed to the trail edge platform 1200. The cable 1600 is guided through the support frame guide members 1400,1401, above the guide member 1513 of the fixed bracket 1511, beneath the guide member 1516 of the movable bracket 1515, above the guide member 1512 of the fixed bracket 1511, through the support frame guide members 1402,1403 and through the trail edge tamper device 1100. The other end of the cable 1600 is fixed to the trail edge clamp mechanism 1300, as will be explained in greater detail hereafter. Since the cable 1600 is guided throughout the clamp actuator system 1000, the activation of the actuation device 1520 manipulates the cable 1600, which in turn manipulates the trail edge tamper device 1100 to operate the clamp members 1331.

The cable 1600 is preferably a light-gauge braided or twisted steel cable, but may also be or include a single wire, rope, and/or the like, and/or may be of any desired material or combination of materials, as long as the cable 1600 is flexible and can support tensile loads. Further, it should also be appreciated that the guides can include pulleys, grooves, and/or any surface or device capable of guiding the cable. It should be also be appreciated that the actuator can include any device such as a solenoid assembly, hydraulic cylinder, threadedly extensible device, or the like, capable of applying a force on the cable to allow the clamp mechanism to clamp a set of compiled substrates during the transfer of the compiled set to a stacking tray, platform, surface or the like. Further, it should be appreciated that the actuator, while depicted as a combination of several elements, can be any desired or necessary number of elements.

Figure 9:
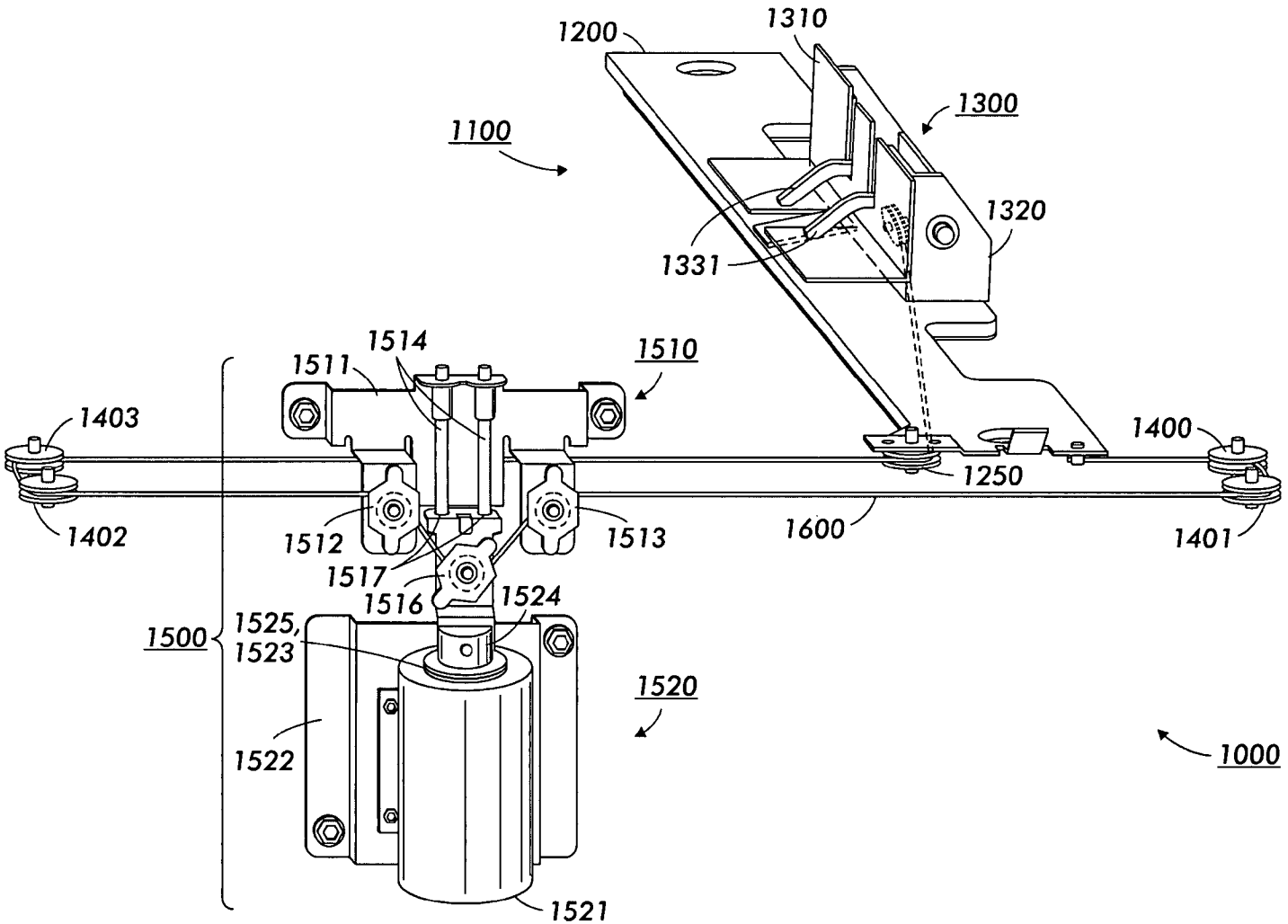
FIG. 9 illustrates in greater detail one exemplary embodiment of the clamp actuator system of FIG. 8, where the clamp actuator system is in an extended position.

FIG. 9 illustrates the exemplary embodiment of the clamp actuator system 1000 of FIG. 8 when the actuator 1500 is activated to place the clamp members 1331 in a clamping position. In this example, it is assumed that the actuation device 1520 is a solenoid. When the actuation device 1520 is activated, a magnetic field is created between the telescoping shaft 1524 and the outer cylinder 1521. As a result, the shaft 1524 telescopes into the outer cylinder 1521 and pulls the movable bracket 1515 towards the outer cylinder 1521. This in turn results in a new tensile force on the cable 1600, which overcomes the spring 1350 force causing the clamp members 1331 to rotate towards a clamping position, as explained in more detail below.

Figure 10:
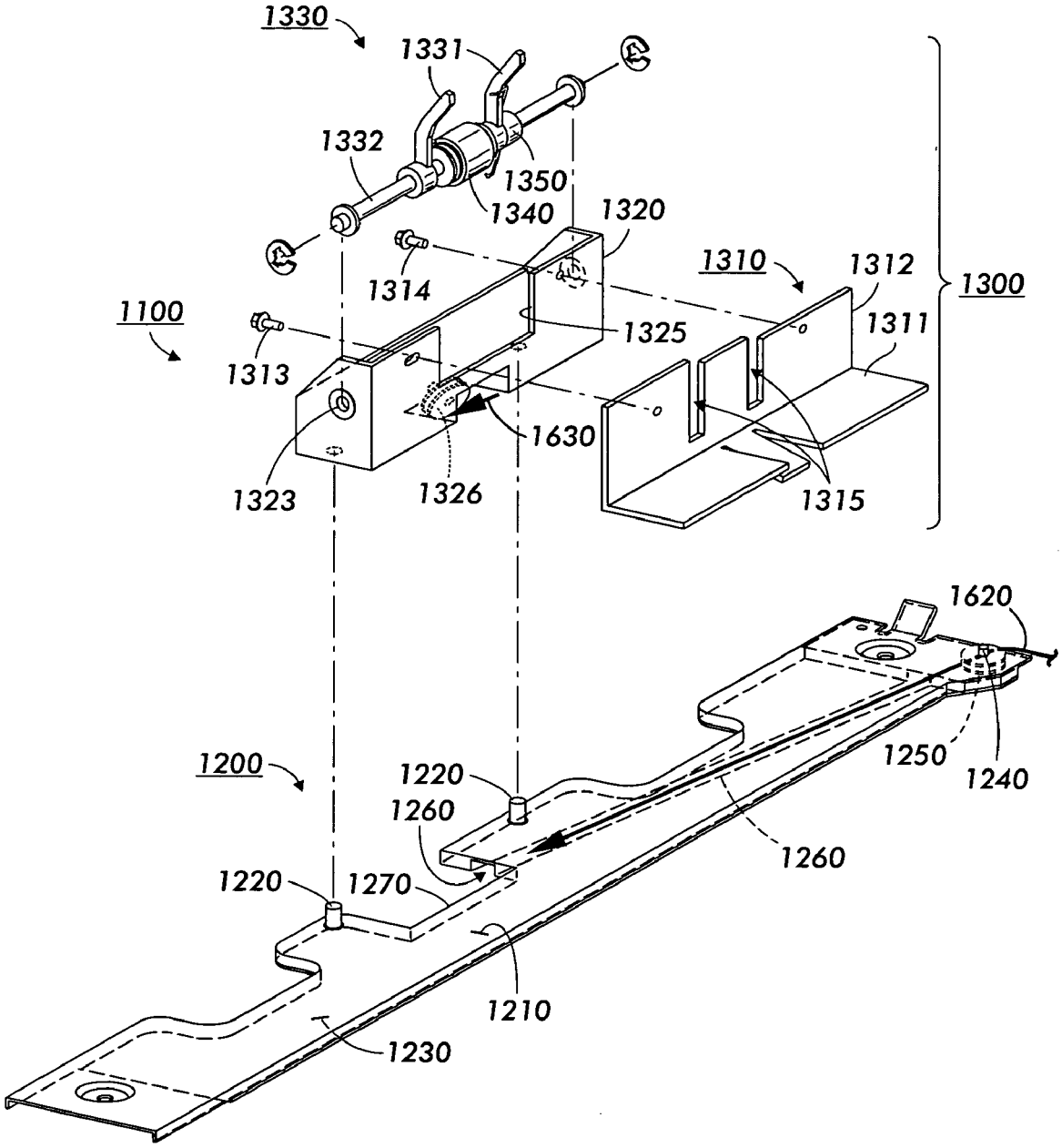
FIG. 10 is an exploded view showing in greater detail one exemplary embodiment of a trail edge tamper device of the of the clamp actuator system of FIGS. 8 and 9.

FIG. 10 is an exploded view illustrating in more detail the trail edge tamper device 1100 of FIGS. 8 and 9. As shown in FIG. 10, the trail edge tamper device 1100 includes the trail edge platform 1200 and the trail edge clamp mechanism 1300. The trail edge clamp mechanism 1300 includes the substrate support device 1310, a housing 1320 and a clamp assembly 1330 having one or more clamp members 1331. Several components of the trail edge tamper device 1100 are discussed in greater detail herein after.

As shown in FIG. 10, the trail edge platform 1200 includes a front surface 1210, an opposing back surface 1230, a groove 1260 and an opening 1270. The front surface 1210 includes two protrusions 1220 for aligning and/or connecting the housing 1320 to the trail edge platform. The back surface 1230 includes a protrusion 1240 that engages with a guide 1250 to guide the cable 1600. The back surface 1230 further includes a groove 1260 that receives and guides the cable 1600 into the housing 1320 (FIG. 12) of the trail edge clamp mechanism 1300 through opening 1270.

The manner in which the cable 1600 is guided through the trail edge platform 1200 is next discussed in greater detail. The cable 1600 is guided through the support frame guide members 1402,1403, and enters the trail edge platform 1200 in the direction of arrow 1620. The cable 1600 is guided by the guide 1250 into the groove 1260. The cable 1600 is guided by the groove 1260 into the opening 1270. The cable 1600 is received by the opening 1270 and enters into the trail edge clamp mechanism 1300 in the direction of arrow 1630.

Figure 11:
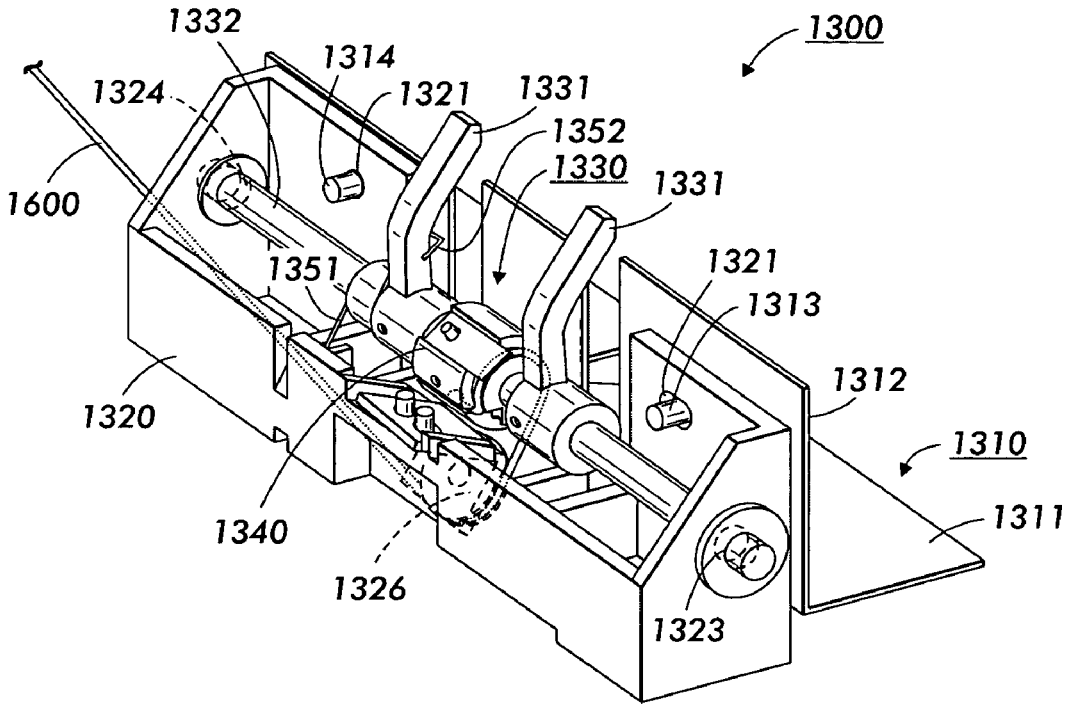
FIG. 11 is a perspective view showing in greater detail one exemplary embodiment of a trail edge clamp mechanism of the clamp actuator system of FIGS. 8 and 9.

FIG. 11 illustrates one exemplary embodiment of the trail edge clamp mechanism 1300 of FIGS. 8–10. As shown in FIG. 11, the trail edge clamp mechanism 1300 includes the substrate support device 1310, the housing 1320 and the clamp assembly 1330. The substrate support device 1310 includes a sheet support surface 1311, preferably substantially horizontal, that is located above a bottom surface of the housing 1320 to support the trail edges of the substrates in the compiled set without the substrates interfering with the movement of the trail edge platform 1200. The substrate support device 1310 further includes a tamp plate 1312, preferably substantially vertical, having a front surface that abuts and tamps the trail edges of the substrates in the compiled set. The tamp plate 1312 also includes protrusions 1313,1314 on a back surface to connect the substrate support device 1310 to the housing 1320. Further, the tamp plate 1312 includes one or more slots 1315, in a central portion thereof, to receive the clamp members 1331 and allow the clamp members 1331 to be moved between the extended and retracted positions.

As shown in FIG. 11, the housing 1320 includes front holes 1321,1322, one or more slots 1325 and side holes 1323,1324. The housing 1320 further includes a guide 1326 located at the bottom of the housing 1320 to receive the cable 1600 as the cable 1600 enters from the opening 1270 of the trail edge platform 1200. The front holes 1321,1322 are located on a front portion of the housing 1320 to receive the protrusions 1313,1314 of the substrate support device 1310 to connect the substrate support device 1310 to the housing 1320. Further, the slots 1325 are also located on the front portion of the housing 1320 and are aligned with the slots 1315 of the substrate support device 1310 to receive the clamp members 1331 and allow the clamp members 1331 to move between the extended and retracted positions. The side holes 1323,1324 are located on side portions of the housing 1320 to rotatably support the clamp assembly 1330 so the clamp members 1331 can move between the extended and retracted positions.

It should be appreciated that the holes and slots described above may include recesses, slots, openings, and/or the like, as long as they can receive an engaging element. It should be appreciated that, while depicted as having two members, the clamp members 1331 may include one or more than two members. Although depicted as a plurality of slots, the slots 1315,1325 may include one or more slots as long as the slots can receive the clamp members 1331 to allow the clamp members 1331 to move between the extended and retracted positions.

As shown in FIG. 11, the clamp assembly 1330 includes the clamp members 1331, a support beam 1332, a guide 1340 and a spring member 1350. The support beam 1332 supports the clamp members 1331, the guide 1340 and the spring member 1350. Further, ends of the support beam 1332 engage the side holes 1323,1324 of the housing 1320 to support the support beam 1332 thereon and rotate the clamp members between an extended position and a retracted position for clamping and releasing the trail edge of a compiled set of substrates, respectively. The spring member 1350 includes one end portion that engages the housing 1320 and another end portion that engages one of the clamp members 1331, or some other member operatively connected to the clamp members 1331. The spring member 1350 provides a force on the clamp members 1331 that urges the clamp members 1331 toward the retracted position.

It should be appreciated that the clamp assembly 1330, while depicted as a combination of several elements, can include one or any desired number of elements. It should also be appreciated that the clamp members 1331, while depicted as a plurality members, can include one or any desired number of members.

The manner in which the cable 1600 is guided through the trail edge clamp mechanism 1300 is next discussed in greater detail. After the cable 1600 is received through the opening 1270 of the trail edge platform 1200, the cable 1600 enters the trail edge clamp mechanism 1300 in the direction of arrow 1630. Then, the cable 1600 is guided by the guide 1250 (shown in FIG. 10), located at the bottom of the housing 1320, onto the guide 1340 fixed on the support beam 1332 of the trail edge clamp mechanism 1300.

Figure 12:
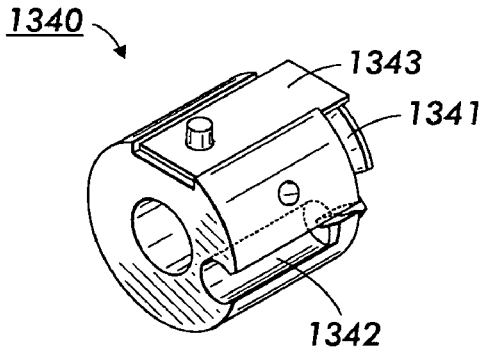
FIG. 12 is a perspective view showing in greater detail one exemplary embodiment of a guide of the trail edge clamp mechanism of FIG. 12.

FIG. 12 illustrates one exemplary embodiment of the guide 1340 of FIG. 12. As shown in FIG. 12, the guide 1340 includes a guide portion 1341, a slot 1342 and a guide cover 1343. The cable 1600 is received by the guide portion 1341 of the guide 1340. The cable 1600 may be wound around the guide portion 1341 several times to provide better frictional holding of the cable 1600 with respect to the guide 1340. The end (not shown) of the cable is held in the slot 1342 via a ball, knot, or the like, attached to the end of the cable. It should be appreciated that the slot 1342 may be slightly smaller than the knot or ball, or may have a reduced portion that creates a tight fit to prevent the cable 1600 from slipping through the slot 1342. In order to prevent the wound cable 1600 from slipping off of the guide 1340, the guide cover 1343 is affixed to the guide 1340.

Figure 13:
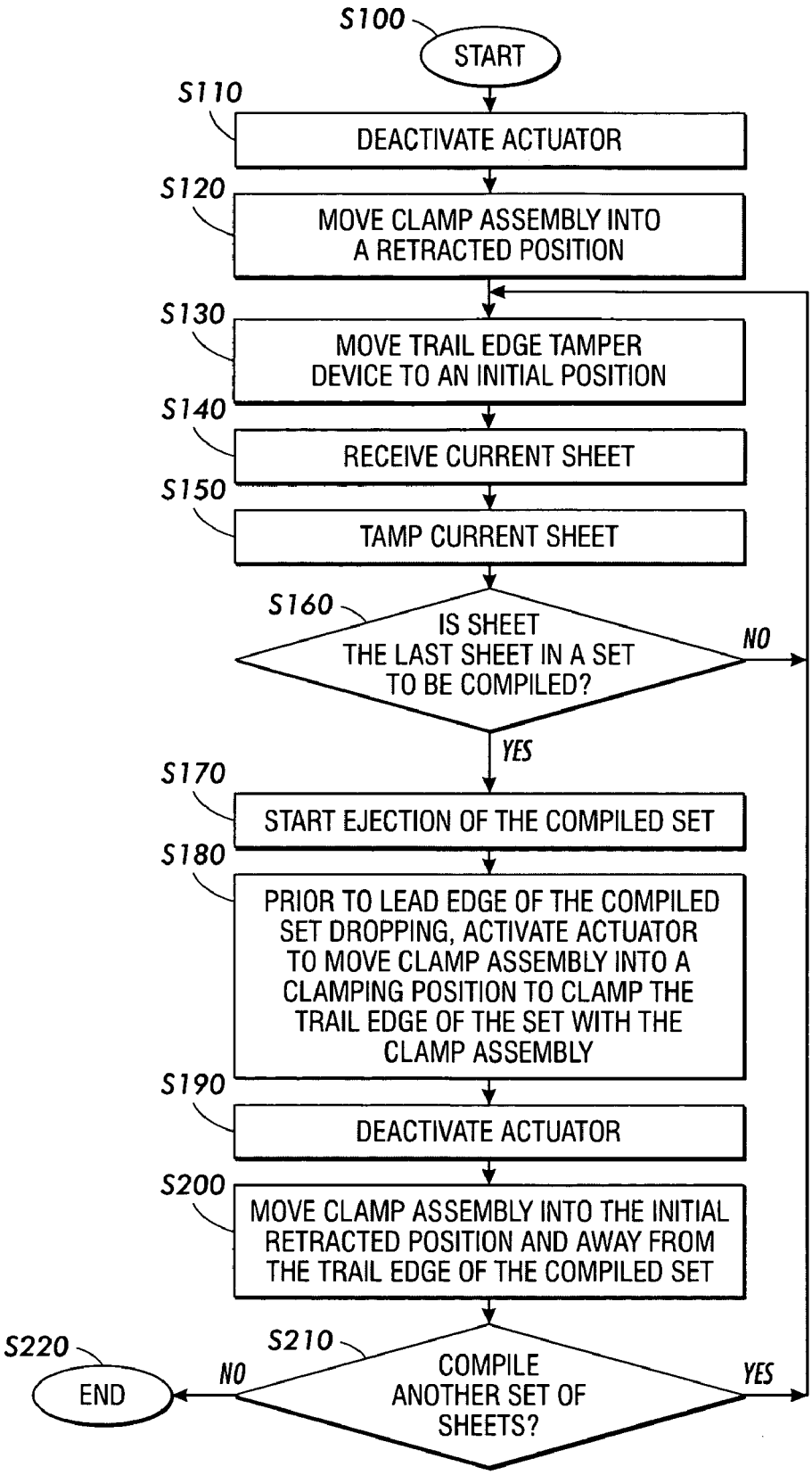
FIG. 13 is a flowchart outlining one exemplary embodiment of a method for clamping and transferring a compiled set of substrates using the clamp actuator system.

FIG. 13 is a flowchart outlining one exemplary method for clamping and transferring substrates. As show in FIG. 13, operation of the method begins in step S100, and continues to step S110, where the actuator is deactivated. Then, in step S120, a trail edge clamp assembly is moved into a retracted position (shown in FIG. 8) so the trail edge assembly can receive a current substrate. Next, in step S130, the trail edge tamper device is moved to an initial position so that the trail edge assembly can receive a current substrate. Operation then continues to step S140.

In step S140, the current substrate is received by the trail edge clamp mechanism. Then, in step S150, the current sheet is tamped by moving the trail edge clamp mechanism toward and away from a second position. The second position is located such that the lead edge of the substrate contacts the initial registration surface and the trail edge clamp mechanism contacts the trail edge of the substrate while the substrate remains horizontal. Then, in step S160, a determination is made whether the current substrate is the last substrate in the set to be compiled. If so, operation continues to step S170. Otherwise, operation returns to step S130.

In step S170, ejection of the compiled set starts. To eject the compiled set, the lead edge ejector moves away from the initial registration surface at a distance so that the lead edge platform no longer supports the lead edge of the compiled set. As the lead edge of the compiled set is pushed by the lead edge ejector 417, the trail edge tamper device 1100 moves along with the moving trail edge platform 1200 at the same distance. Operation then continues to step S180.

In step S180, prior to a lead edge of the compiled set dropping, the actuator is activated to move the trail edge clamp mechanism into a clamping position in order to clamp the trail edge of the compiled set with the clamp assembly. Then, in step S190, the actuator is deactivated. Next, in step S200, the trail edge clamp mechanism is moved into the retracted position and away from the trail edge of the compiled set. Then, in step S210, a determination is made whether another set of substrates is to be compiled. If so, operation returns to step S130. Otherwise, operation of the method continues to step S220, where operation of the method ends.

In the foregoing description, it is assumed that the "rest" position of the clamp assembly is the position that results when the actuator is deactivated. However, if the "rest" position is a clamping position, it will be appreciated that the "deactive actuator" steps could actually be "activate actuator" steps, and vice versa.

While this invention has been described in conjunction with the exemplary embodiments outlined above, many alternatives, modifications and/or variations to the exemplary embodiments are possible within the spirit and scope of the invention.

What is claimed is:

1. A substrate compiling system, comprising:
an actuator;
a cable guided through the actuator; and
a tamper device connected to the cable,
wherein the tamper device is configured to tamp a trail edge of a compiled set of substrates, and the actuator is configured to act on the cable by changing a lateral force with respect to a longitudinal direction of the cable through the actuator to cause the tamper device to clamp the trail edge of the compiled set and to release the trail edge of the compiled set.

2. The substrate compiling system of claim 1, wherein the tamper device continues to clamp the compiled set until a lead edge of the compiled set, opposing the trail edge of the compiled set, engages a lower platform.

3. The substrate compiling system of claim 1, wherein the actuator includes:
an actuation device;
a guide bracket connected to the actuation device; and
a guide connected to the guide bracket to guide the cable to activate the tamper device.

4. The substrate compiling system of claim 3, wherein the actuation device includes a solenoid.

5. The substrate compiling system of claim 1, wherein the tamper device includes:
a platform that guides the cable; and
a clamp mechanism connected to and supported by the platform, wherein the platform is moved to position the clamp mechanism to tamp and align the trail edge of the compiled set.

6. The substrate compiling system of claim 5, wherein the clamp mechanism includes:

a substrate support device;

a housing that supports the substrate support device; and a clamp assembly connected to and supported by the support device.

7. The substrate compiling system of claim 6, wherein a movement of the platform is not affected by the actuator acting on the cable.

8. The substrate compiling system of claim 6, wherein the clamp assembly rotates with respect to the housing into an extended position, to clamp the trail edge of the compiled set, and a retracted position, to release the trail edge of the compiled set.

9. The substrate compiling system of claim 8, wherein the clamp assembly includes at least one clamp member that contacts and clamps the trail edge of a compiled set between the at least one clamp member and the substrate support.

10. The substrate compiling system of claim 7, wherein the platform includes a groove and a pulley that guides the cable.

11. The substrate compiling system of claim 7, wherein one end of the cable is fixed to the platform and another end of the cable is fixed to the clamp mechanism.

12. The substrate compiling system of claim 1, wherein the actuator is configured to exert a lateral force with respect to a longitudinal direction of the cable through the actuator.

13. A method for clamping and transferring substrates of a compiled set, comprising:

guiding a cable through an actuator;

connecting the clamp assembly to the cable;

moving the clamp assembly from a retracted position to an extended position to clamp an edge of the compiled set by acting on the cable;

moving the clamp assembly to drop the edge of the compiled set; and moving the clamp assembly from the extended position to the retracted position to release the edge of the compiled set by acting on the cable, wherein acting on the cable includes changing a lateral force with respect to a longitudinal direction of the cable through an actuator.

14. The method of claim 13, wherein the edge of the compiled set remains clamped until an edge of the compiled set, opposing the edge of the compiled set, engages a lower platform.

15. The substrate compiling system of claim 13, wherein changing a lateral force includes exerting a lateral force with respect to a longitudinal direction of the cable through the actuator.

16. A method for clamping and transferring substrates of a compiled set, comprising:

guiding a cable through an actuator;

connecting the clamp assembly to the cable;

moving a clamp assembly from a retracted position to an extended position to clamp an edge of the compiled set by acting on the cable; and moving the clamp assembly from the extended position to the retracted position to release the edge of the compiled set by acting on the cable, wherein acting on the cable includes changing a lateral force with respect to a longitudinal direction of the cable through an actuator.

17. The substrate compiling system of claim 16, wherein changing a lateral force includes exerting a lateral force with respect to a longitudinal direction of the cable through the actuator.

* * * * *